United States Patent [19]

Thien et al.

[11] 3,995,603

[45] Dec. 7, 1976

[54] COOLER-CUM-BLOWER ASSEMBLY FOR INTERNAL COMBUSTION ENGINES

[75] Inventors: Gerhard Thien; Heinz Fachbach; Josef Greier, all of Graz, Austria

[73] Assignee: Hans List, Graz, Austria

[22] Filed: Feb. 20, 1976

[21] Appl. No.: 659,964

Related U.S. Application Data

[62] Division of Ser. No. 507,525, Sept. 19, 1974.

[30] Foreign Application Priority Data

Apr. 8, 1974 Austria ..... 2934/74

[52] U.S. Cl. ..... 123/41.51; 123/41.49; 165/51

[51] Int. Cl.[2] ..... F01P 3/20

[58] Field of Search ..... 165/51; 123/41.49, 41.51, 123/41.57, 41.65, 41.66

[56] References Cited

UNITED STATES PATENTS

| | | | |
|---|---|---|---|
| 1,747,868 | 2/1930 | Guernsey | 123/41.51 |
| 2,115,124 | 4/1938 | Schittke | 123/41.49 |
| 2,423,929 | 7/1947 | Dilworth | 123/41.49 |
| 3,842,902 | 10/1974 | Poslusny | 165/51 |
| 3,858,644 | 1/1975 | Beck | 165/51 |

*Primary Examiner*—Charles J. Myhre
*Assistant Examiner*—Daniel J. O'Connor
*Attorney, Agent, or Firm*—Watson, Cole, Grindle & Watson

[57] ABSTRACT

A cooler-cum-blower assembly for internal combustion engines with two water-cooler elements arranged in front of the front side of the engine, said cooler elements being located opposite each other in relation to the longitudinal median plane of the engine and each forming an acute angle with the longitudinal median plane of the engine on the side facing away from the engine, and with an axial blower located in front of the cooler elements and actuated by means of the engine.

3 Claims, 7 Drawing Figures

COOLER-CUM-BLOWER ASSEMBLY FOR INTERNAL COMBUSTION ENGINES

Figure 1:
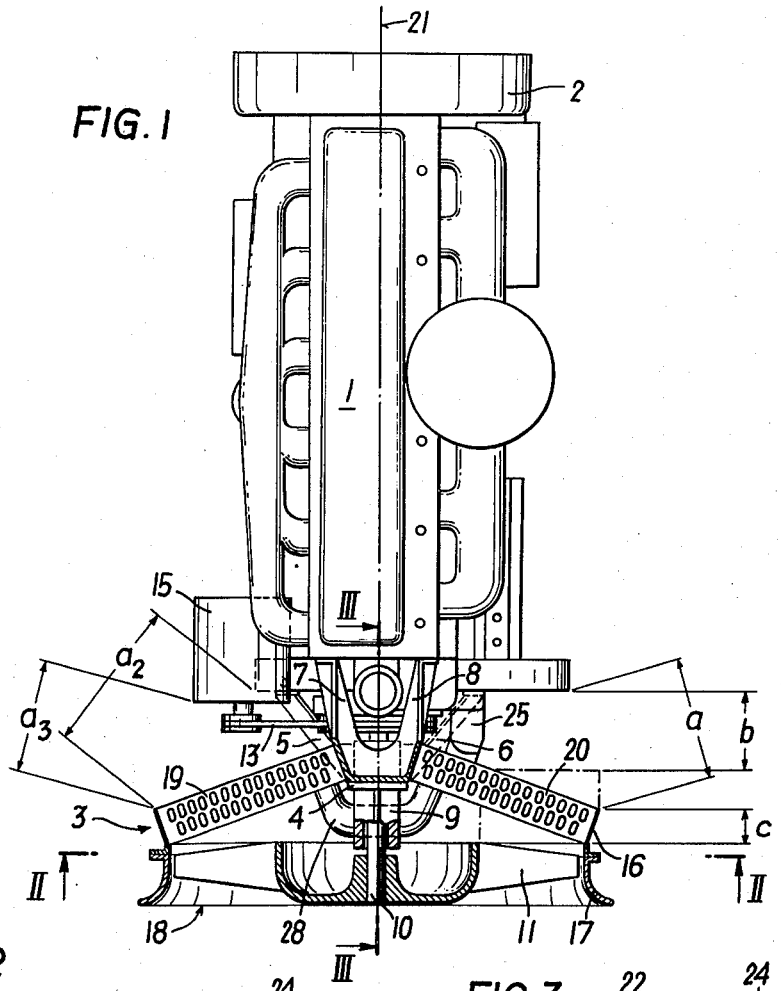

This is a division of application Ser. No. 507,525, filed Sept, 19, 1974.

The present invention relates to a cooler-cum-blower assembly for internal combustion engines, in particular for automotive engines, comprising a cooler arranged in front of the engine and ventilated by means of an axial blower.

It is nowadays customary for automotive engines, building machines or stationary installations, to have the impeller of the axial blower secured to a shaft located on the engine, for example, to the water pump driving shaft at a very short distance from the front end of the engine and to have the water cooler arranged close to and in front of the blower supported separately on the frame. There are, however, substantial drawbacks inherent in this arrangement as far as considerations of flow technique are concerned. Owing to the short distance between the cooler and the blower and the unfavorable flow-off conditions resulting from obstacles presented by the engine surfaces, the blower is called upon to produce an amount of pressure far greater than would be required to overcome the cooler resistance alone. Consequently, the noise produced by such a blower is considerably in excess of such values as would result for the same quantity of air if the cooler resistance alone would have to be overcome under ideal inflow and outflow conditions.

If in addition thereto a housing closing the space between the cooler and the blower is provided which is usually rigidly connected to the frame, relatively reduced blower efficiency has to be put up with as a further drawback because of the necessity to design the blower with a comparatively large impeller clearance in view of the relative motions between the engine and the frame as well as because of the generally coarse manufacturing tolerances prevailing in the field of ventilator construction.

Theoretically, it would be possible to improve upon flow conditions by providing larger distances between the cooler and the blower on the one hand and between the blower and the engine on the other hand, but this is not practically feasible because of the considerable increase in the overall length of such an arrangement.

It is the purpose of the invention to provide a cooler-cum-blower assembly avoiding the shortcomings of known types as hereabove described, and meeting both the aerodynamic requirements and the necessity of maximum absorption of sound. According to the invention, this problem is to be solved by locating the blower on the side of the cooler facing away from the engine and by providing a cooler comprising at least two upright cooler elements arranged opposite each other in relation to the longitudinal median plane of the engine and forming each an acute angle with the longitudinal median plane of the engine on the side facing away from the engine.

This arrangement ensures the completely smooth inflow to the blower and considerably reduced resistance to flow at the delivery end of the blower. In fact, due to the bipartition of the cooler and the inclination of the cooler elements the flow cross-sections between the engine and the cooler are essentially enlarged as compared with conventional arrangements comprising a single flat cooler. At the same time, pressure losses and noise caused by obstacles to the free flow are considerably reduced without any enlargement of the overall length as compared with known blower-cum-cooler assemblies. Improved flow conditions both in the supply and in the exhaust air paths of the blower make it possible to considerably lower the blower pressure as compared with conventional values so that it will be only slightly higher than the pressure required to overcome the resistance of the cooler alone. Therefore, the efficiency of the blower is much better than with conventional cooler-ventilator arrangements.

A cooling system for diesel locomotives is known to exist, comprising two cooler blocks located opposite each other in an inclined position and ventilated by means of axial blowers. However, this assembly is completey separated from the internal combustion engine so that the basic problem of the present inventon will not arise. The two axial blowers are arranged in tandem in the longitudinal direction of the vehicle with vertical shafts and the two cooler blocks provide a rooflike covering of the two blowers, likewise extending in the longitudinal direction of the vehicle. The blowers are actuated by hydrostatic means. Louvers are provided for the inflow and outflow both on the sidewalls and on the roof of the locomotive.

According to a preferred embodiment of the invention, a central bracket comprising the bearing for the blower shaft is attached to the front end of the engine, preferably with the interposition of sound-proofing elements, said central bracket supporting an intermediate housing closing the space between the blower and the cooler elements upwards and downwards and having on the side facing away from the engine a flange to which the outer ring of the blower is attached. Thus the cooler-cum-blower assembly forms a compact and rigid structural unit which can be attached to and removed from the engine at low fitting expense, its rigid construction making it possible to keep the clearance between the impeller and the outer ring of the blower very small, which leads to a further improvement of blower efficiency. The interposition of sound-proofing elements at the points of attachment of the central bracket to the engine is advisable for the purpose of precluding the introduction of sound conducted through solids from the engine into the cooler-cum-blower assembly and the resulting noise radiation from the surfaces of this structural unit.

According to a further feature of the invention the blower shaft supports in a manner known per se at the engine-end a vee-belt pulley driven by means of the crankshaft via vee-belts. The same vee-belts can be used as is customary, simultaneously for the operation of the dynamo or any other auxiliary machine of the internal combustion engine.

In special cases it may be also advantageous to provide a blower drive wherein according to the invention, the blower shaft is drivingly connected with a driven shaft of the engine via a cardan shaft, a flexible coupling or the like. Such a driving means deserves preference in such cases where as a result of an extremely elastic connection between the cooler-cum-blower assembly and the engine or where the cooler-cum-blower assembly is supported independently from the engine, as for example, on the frame of the associated vehicle, major relative motions between the blower shaft and the engine are to be expected.

If the invention is to be applied to an encased engine with an intermediate space between the encasing and the outer surfaces of the engine through which cooling air flows, particular advantages can be obtained if part of the blower air is directed from the space located between the blower and the cooler elements, preferably through a connecting shaft branching off the intermediate housing above the central bracket, into the space between the encasing and the outer surfaces of the engine. Experience goes to show that the quantity of air required for the ventilation of this interspace for the purpose of evacuating the excess heat of the engine is a mere function of the total amount of air needed, so that it suffices to increase the performance of the blower as compared with the standard type of cooler-cum-blower assembly to a negligible extent only.

Figure 2:
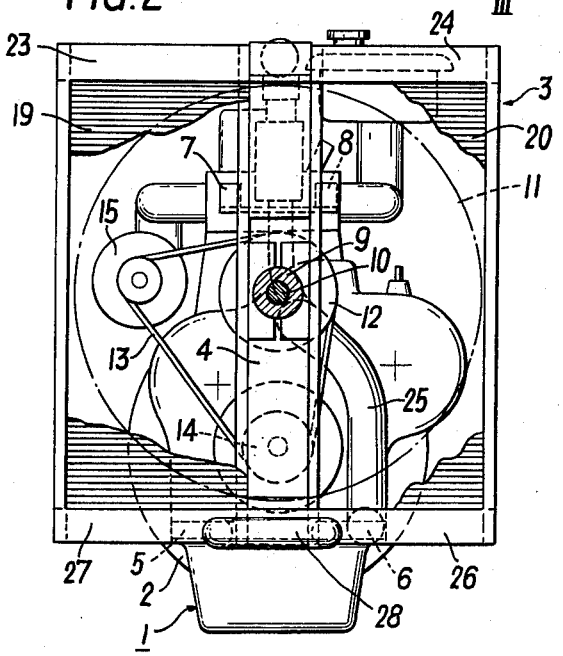
Figure 3:
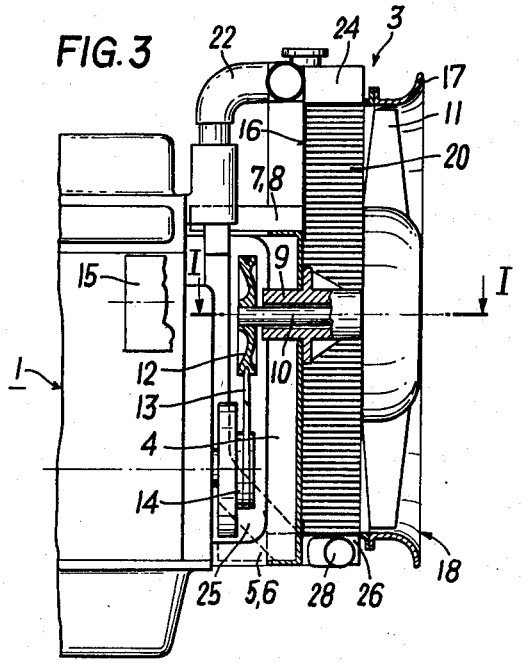
Figure 5:
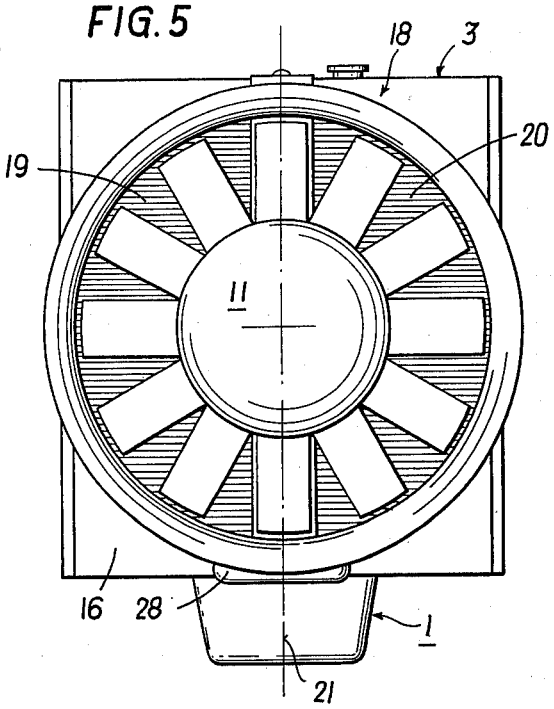
Figure 6:
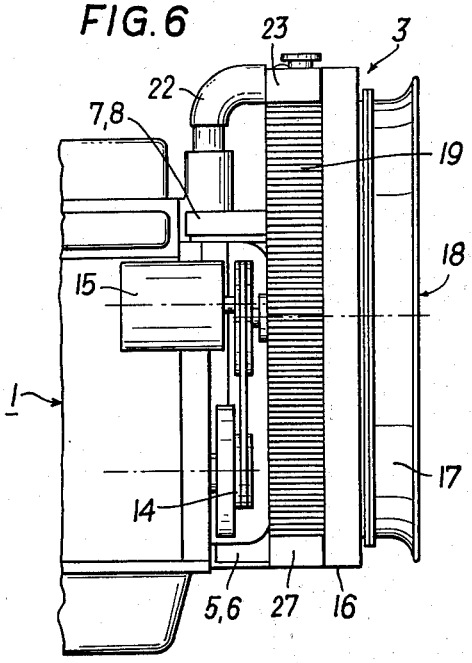
Figure 4:
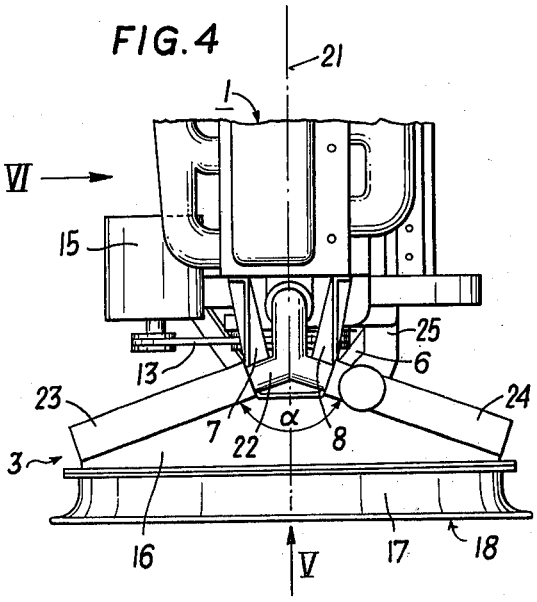
Figure 7:
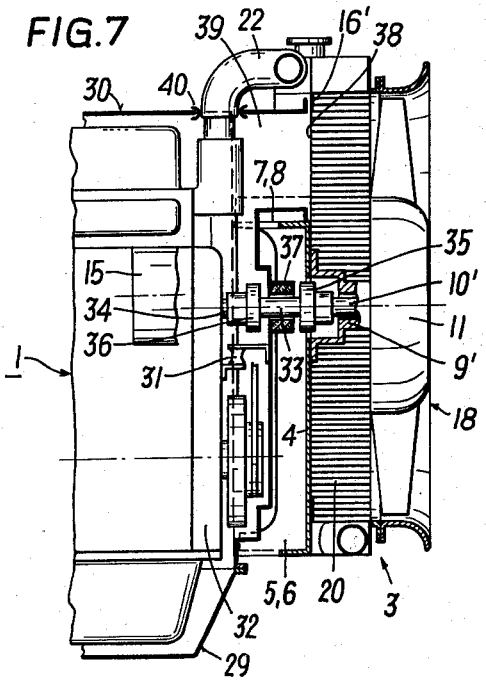

Further details of the invention will become apparent from the following description of an embodiment of the invention with reference to the accompanying drawing wherein FIG. 1 shows a top plan view of a water-cooled six-cylinder diesel engine with a horizontal cross-section taken substantially along line I — I of FIG. 3 of the cooler-cum-blower assembly according to the invention, FIG. 2 is a part-sectioned front-view of the engine taken substantially along line II—II of FIG. 1, FIG. 3 a side elevation of the same engine with a sectional view of the cooler-cum-blower assembly taken substantially along line III—III of FIG. 1, FIG. 4 a top plan view of the same engine corresponding to FIG. 1, FIG. 5 a front elevational view taken in the direction of the arrow V in FIG. 4, FIG. 6 a partial side elevational view of the engine taken in the direction of arrow VI in FIG. 4, and FIG. 7 a partly sectional side elevation corresponding to the illustration in FIG. 3 of an engine provided with an encasing with a cooler-cum-blower assembly according to the invention.

The diesel engine 1 shown in the drawing supports on the front end facing away from the flywheel flange 2 the cooler-cum-blower assembly 3 according to the invention designed as a self-contained structural unit. The supporting element of the assembly is a central bracket 4, supported on the engine 1 by means of two lower supporting arms 5, 6 and two upper supporting arms 7, 8. For greater simplicity, the connection of the supporting arms 5 thru 8 with the engine 1 is shown in the drawing as being of the rigid type although in order to avoid the introduction of sounds conducted through solids from the engine into the cooler-cum-blower assembly 3 it is advisable to insert sound-isolating elements between the engine and each of the supporting arms.

Incorporated in the central bracket 4 designed as a vertical "C" beam with profile legs diverging towards the engine side is the bearing housing 9 for the blower shaft 10 supporting the blower impeller 11 designed as an axial rotor at the front end and the vee-belt pulley 12 at the rear end. The blower is driven by means of the vee-belt pulley 14 arranged at the front end of the crankshaft via a vee-belt 13. The same vee-belt 13 also serves to drive the dynamo 15.

Attached to the central bracket 4 is an intermediate housing 16 having a flange at its front end to which the outer ring 17 of the blower indicated as a whole by reference number 18 is attached.

The water cooler of the assembly 3 comprises two separate upright cooler elements 19 and 20 located opposite each other in a symmetrical arrangement in relation to the longitudinal median plane 21 of the engine and forming an angle $\alpha$ between each other on the side facing away from the engine 1, said angle being less than 180°. With the inner side faces facing each other, the cooler elements 19, 20 are connected to the profile legs of the central bracket 4 and with the remaining peripheral areas to the intermediate housing 16, so that the cooling-air drawn in by the blower can emerge through the cooler elements exclusively.

The cooling water discharged at the cylinder head of the engine 1 is directed to the two upper water boxes 23 and 24 of the cooler elements 19, 20 through a distribution conduit 22 located approximately in the longitudinal median plane 21 of the engine. For considerations of space saving, the suction pipe 25 serving as a connection between the cooler and the water pump of the engine is directly connected to the one lower water box 26 of the cooler element 20 located on the right side of the front view shown in FIG. 2, said water box communicating in turn with the left-hand lower waterbox 27 by means of a pipe 28.

With reference to the dimensions shown in FIG. 1 the design of the cooler-cum-blower assembly 3 hereabove described produces the following new and advantageous results as compared with the conventional arrangement of a flat cooler ventilated by means of an axial blower: Due to the bipartition of the cooler and the inclination of the two elements 19, 20, the distance *c* between the hub of the blower impeller 11 and the cooler and the axial distance between the blower and the front-end of the engine remaining equal, the air outlet cross-sections *a*1, *b*2 and *a*3 between the cooler and the engine are considerably larger than if a conventional single flat cooler is used in the position indicated by dash-and-dot lines. With such a flat cooler the cross-section available for the outflow of the blower air from the cooler and designated by reference symbol *b*1 is substantially smaller and the air emerging from the flat cooler in an axial direction is as a result of the obstacles obstructing the smooth flow at the front-end of the engine, imparted a vehement deflection in a radial direction accompanied by heavy loss of pressure.

On the contrary, when using the cooler-cum-blower assembly 3 according to the invention, the air emerges from the cooler elements 19, 20 already in a direction which is inclined in relation to the longitudinal median plane 21 of the engine and need not be strongly deflected when flowing around the engine 1. Consequently, the blower pressure required is much lower than with conventional blower-cum-cooler assemblies, as a result of which not only the power required of the blower is reduced but also the noise produced by the assembly diminishes because the sound produced by the blower decreases in proportion to the drop in blower pressure.

FIG. 7 illustrates yet another variant of a cooler-cum-blower assembly according to the invention in connection with an engine provided with an encasing 29, 30. According to this design, the cooler-cum-blower assembly 3 is supported by the front wall of the encasing with supporting arms 5 thru 8 which are of lesser length than those in the embodiments of the invention hereabove described, the front wall of the encasing being in turn connected to the engine 1 with the interposition of sound-isolating supporting elements. Such a supporting element 31 is shown at the front-end of the engine as attached to the gear-box cover.

In order to permit relative motions between the cooler-cum-blower assembly 3 rigidly connected to the encasing 29, 30 and the engine 1, the blower impeller 11 is driven by means of a drive-shaft 33. At the engine end, the same is connected to a shaft 34 emerging from the gear-box 32, and on the blower end, to the blower 10' which is shorter than the types hereabove described. In order to provide space for the location of the drive-shaft 33 and/or for the front hinge 35, the bearing housing 9' has been shortened and placed closer to the blower impeller 11. The rear shaft hinge 36 is located inside the encasing. Accomodation of the shaft hinge 36 located close to the engine inside the encasing offers the advantage that when sound-isolating shaft hinges, such as rubber hinges, are used, the portion of the shaft emerging through the sealing 37 presents only little sound conducted through solids from the engine. Since the blower shaft 10' is now directly coupled with a shaft 34 emerging from the engine, in the embodiment illustrated in FIG. 7 the vee-belt 13' merely serves for the drive of the dynamo 15, and occasionally also for the operation of appliances not shown in the drawing, such as the cooling-water pump, an air compressor, a hydraulic pump or any other auxiliary devices.

It is customary for engines provided with encasings to have the space between the encasing and the outer surfaces of the engine ventilated by means of a blower in order to eliminate excess heat and to protect the encasing from overheating as a result of heat accumulation. In the present case, part of the cooling-air supplied by the blower 11 is directed through an aperture 38 of the intermediate housing 16' provided above the central bracket 4 via a connecting shaft 39 into the space enclosed by the encasing 29, 30. This cooling-air branch current then sweeps alongside the outer surfaces of the engine and emerges from the encasing through an aperture not shown in the drawing.

Since the encasing 29, 30 and the cooler-cum-blower assembly 3 are sound-isolated from the engine 1, in addition to the connection between the blower and the engine, all of the remaining connections between the engine and the cooler-cum-blower assembly 3 and/or the encasing 29, 30 are of the flexible type. Among these flexible elements there are the upper cooler connection 22 designed as a rubber hose and/or the sealing 40 at its passage through the encasing 29, 30.

Within the scope of the invention, the direction of flow of the cooler-cum-blower assembly can be reversed as compared with the arrangement described with reference to the above-mentioned embodiments of the invention. Such a reversal of flow would be advantageous for such vehicles where the engine is located in the rear of the vehicle, because in such a case the pressure head of the driving wind cannot be taken advantage of for the delivery of air through the cooler and better results are obtained if the air is carried away off the front-end of the engine.

I claim;

1. A cooler-cum-blower assembly for internal combustion engines surrounded by an encasing, with an interspace between the encasing and the outer surface of the engine through which cooling-air flows, comprising a water-cooler including two upright cooler elements located in front of a front end of the internal combustion engine opposite each other in relation to a longitudinal median plane of the engine, each of the cooler elements forming an acute angle with said longitudinal median plane on the side facing away from the engine, an axial blower actuated by the engine and arranged in front of the two cooler elements, said axial blower comprising a blower shaft, a blower impeller mounted thereon, and an outer ring encompassing the blower impeller, further comprising a central bracket attached to said front-end of the engine, a bearing for the blower shaft located on the central bracket, an intermediate housing attached to said central bracket and extending from the cooler elements as far as the axial blower, said intermediate housing closing the space between the cooler elements and the blower in an upward and downward direction and comprising a flange on its side facing away from the engine, said outer ring of the blower being attached to said flange, and a connecting cooling-air shaft extending from the said intermediate housing as far as the interspace between the encasing and the outer surface of the internal combustion engine.

2. A cooler-cum-blower assembly according to claim 1, wherein said connecting cooling-air shaft emerges from the intermediate housing at a point located above said central bracket.

3. A cooler-cum-blower assembly according to claim 1, further including a driven shaft on said internal combustion engine, an intermediate shaft having an inner and an outer extremity, the inner extremity of the intermediate shaft being connected with said driven shaft of the engine, the outer extremity of the intermediate shaft being connected with said blower shaft, said encasing surrounding the engine having a front wall located between the cooler elements and the said front end of the engine and having an opening, a sound absorbing sleeve provided on said front wall of the encasing in alignment with said sleeve, the said intermediate shaft penetrating the opening of the said front wall of the encasing and the said sound absorbing sleeve.

* * * * *